US006036185A

United States Patent [19]

Baumann et al.

[11] Patent Number: 6,036,185

[45] Date of Patent: Mar. 14, 2000

[54] SYSTEM FOR UNSTACKING AND OPENING ENVELOPES

[75] Inventors: Herve Baumann, Paris; Gerard Coudray, Andresy, both of France

[73] Assignee: SECAP, France

[21] Appl. No.: 09/068,843

[22] PCT Filed: Nov. 4, 1996

[86] PCT No.: PCT/FR96/01729

§ 371 Date: Aug. 7, 1998

§ 102(e) Date: Aug. 7, 1998

[87] PCT Pub. No.: WO97/18957

PCT Pub. Date: May 29, 1997

[30] Foreign Application Priority Data

Nov. 17, 1995 [FR] France ..... 95 13646

[51] Int. Cl.[7] ..... B65H 5/00

[52] U.S. Cl. ..... 271/2; 271/35; 271/902

[58] Field of Search ..... 271/2, 10.06, 10.08, 271/34, 35, 225, 902

[56] References Cited

U.S. PATENT DOCUMENTS

| | | | |
|---|---|---|---|
| 2,267,574 | 12/1941 | Post . | |
| 2,766,569 | 10/1956 | Strother et al. . | |
| 2,915,863 | 12/1959 | Kummer . | |
| 5,410,860 | 5/1995 | Coudray et al. . | |
| 5,450,187 | 9/1995 | Pei et al. | 271/2 X |
| 5,971,385 | 10/1999 | Belec | 271/2 |

FOREIGN PATENT DOCUMENTS

| | | |
|---|---|---|
| 0 336 674 | 11/1989 | European Pat. Off. . |
| 0 504 114 | 10/1992 | European Pat. Off. . |
| WO 95/16578 | 6/1995 | WIPO . |
| WO 95/23070 | 8/1995 | WIPO . |

*Primary Examiner*—David H. Bollinger
*Attorney, Agent, or Firm*—St. Onge Steward Johnston & Reens LLC

[57] ABSTRACT

A device for unstacking and opening envelopes from a stack of envelopes is provided. The device includes a frame having a receptacle area for receiving the stack. At least one, but preferably two, endless belts are located at the bottom of the receptacle area for extracting an envelope from the bottom of the stack, the flap of the envelope folded and oriented upwardly and in a forward direction. At least one set, but preferably two sets, of cooperating drive rollers rotating in opposite directions are arranged such that the extracted envelope can pass therebetween. The drive rollers move the extracted envelope in a feed direction dependent on the direction of drive roller rotation. A fixed wedge-shaped deflector is located downstream from the drive rollers and is arranged at an angle relative to the forward feed direction. A position detector is also provided for detecting the position of the extracted envelope with respect to the fixed deflector, as is a controller for controlling the endless belts and the drive rollers.

22 Claims, 8 Drawing Sheets

SYSTEM FOR UNSTACKING AND OPENING ENVELOPES

FIELD OF THE INVENTION

The present invention relates to a device for unstacking and opening envelopes from a stack of envelopes.

The present invention is particularly aimed at such unstacking and opening devices for offices.

DESCRIPTION OF THE PRIOR ART

U.S. Pat. No. 2,267,574 describes a device for unstacking comprising a frame, means for stacking a pile of envelopes, flap down, means for extracting an envelope from the bottom of the pile and means for feeding the extracted envelope downstream from the extracting means.

In this patent, as well as in subsequent systems (see for example EP-A-0 336 674, U.S. Pat. No. 2,915,863, EP-A-0 504 114, WO-A-95/16578), the flap of the extracted envelope is opened with a movable instrument, such as a claw, which introduces certain complications with respect to its kinematics and is an inefficient use of space.

SUMMARY OF THE INVENTION

The object of the invention is to improve on the known unstacking devices by increasing the compactness and by simplifying the mechanical actuators therein.

In accordance with the invention, this object is achieved with a device, for unstacking and opening envelopes from a pile of envelopes with the flap down, comprising:

- a frame;
- means for stacking a pile of envelopes with folded-down flaps;
- means for extracting an envelope from the bottom of the pile;
- first drive means for moving the extracted envelope downstream from said first drive means;
- characterized in that said system further includes:
  - a fixed wegde-shaped deflector arranged at an angle to the feed direction downstream from said first drive means;
  - second drive means for moving the extracted envelope downstream, located upstream from said fixed wedge-shaped deflector;
  - detection means for detecting the position of the extracted envelope with respect to said deflector;
  - control means for the extraction means and the first and second drive means responsive to a signal from said detection means in order to control:
  - firstly, the extraction of an envelope and its forward feeding, flap down, at the front and on the side of the deflector relative to the path until the flap has been deflected and travelled beyond said deflector;
    - secondly, the feeding of the envelope backwards so that the flap and the envelope position themselves over the deflector as they move backwards, whereby the flap is folded out during backward movement until it is coplanar with the body of the envelope; and
    - thirdly, the final feeding of the envelope forwardly in the downstream direction of the device.

By wedge-shaped deflector, it is understood that its corner shape, preferably rounded out, allows the deflector to deviate the flap during backward movement and permit its folding out.

Advantageously, the extraction means are in the form of an endless belt at the bottom of the stacking means and cooperate with an extraction space at the bottom of a wall of the stacking means. The extraction means can cooperate with envelope separating means located downstream, for example rollers placed on either side of the path of the envelope and rotating in the same direction.

Advantageously, the first and second drive means are in the form of contra-rotating rollers in mutual support.

The first and second drive means are preferably overlapping and driven by a two-way motor.

It may be particularly advantageous to aid in the folding out of the flap to provide a movable flap located downstream from the deflector.

This movable flap will also preferably participate in the subsequent processing of the envelope, particularly by placing it on the insertion fingers of the insertion machine itself, the insertion machine being placed downstream from the path of the envelope. This movable flap and these insertion fingers are described in application no. WO-A-95/16578, to which reference may be made.

The unstacking device according to the invention further advantageously includes a pressing device for the stack of envelopes, the actuation of which may be monitored by detection means to actuate the unstacking device.

BRIEF DESCRIPTION OF THE DRAWINGS

The present invention and its advantages will be more easily understood after reading the following non-restrictive description of preferred embodiments thereof, made with reference to the following drawings, in which.

DESCRIPTION OF A PREFERRED EMBODIMENT OF THE INVENTION

Figure 1:
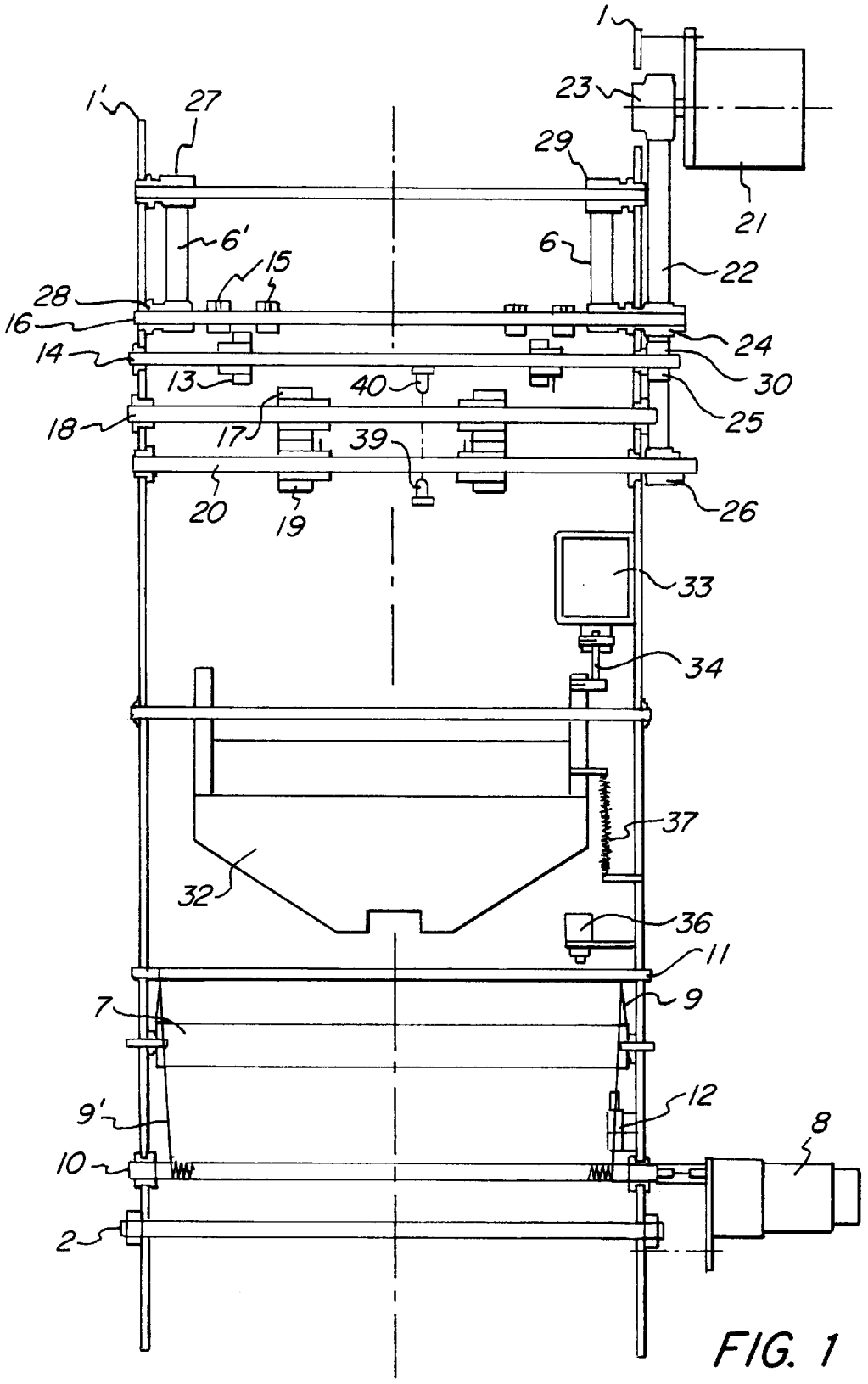
FIG. 1 is a front view of an unstacking device according to the present invention.
Figure 2:
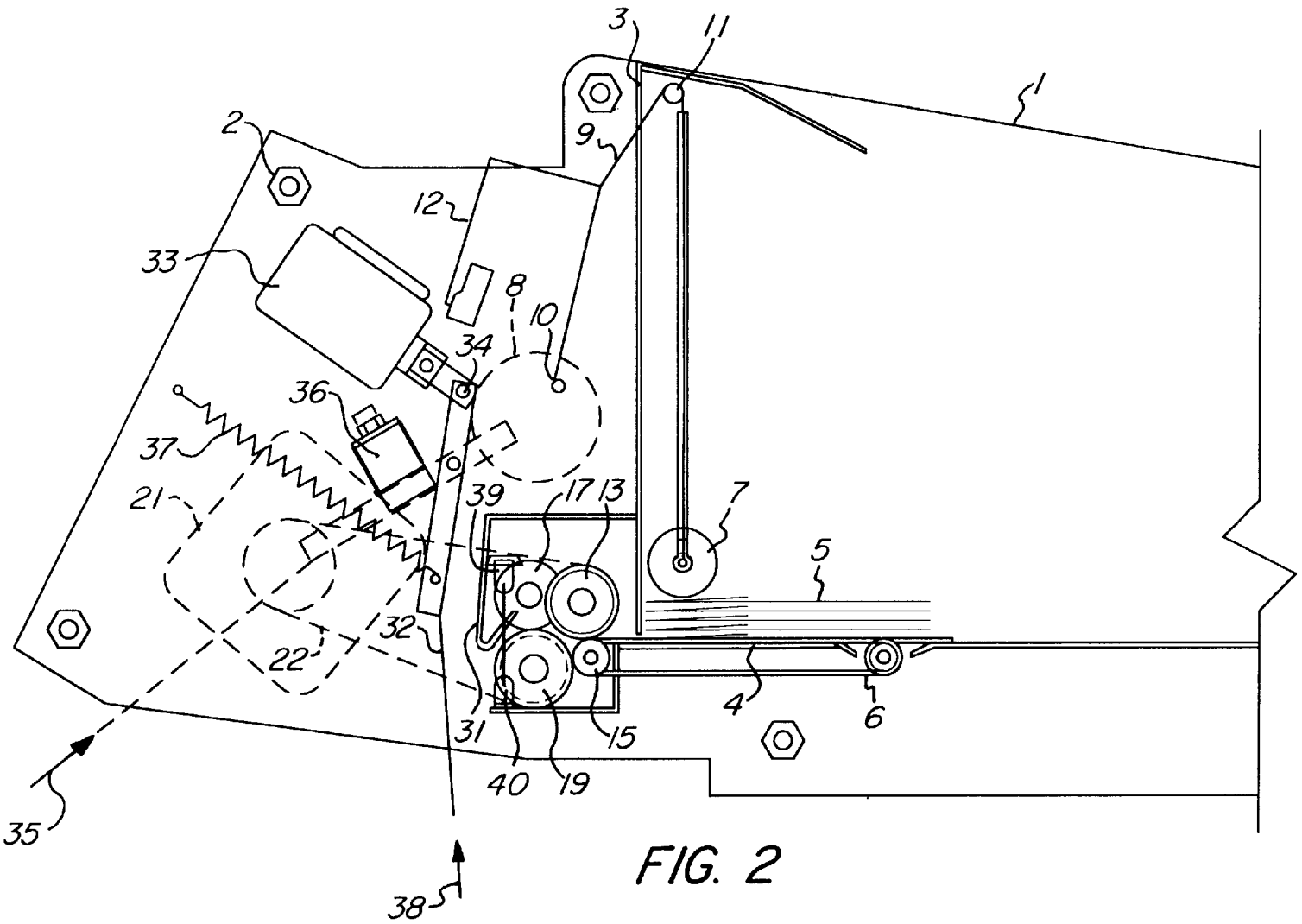
FIG. 2 is a cross-sectional view of the unstacking device of FIG. 1.

The unstacking device includes a frame or principal structure comprising plates 1, 1' and a plurality of supports 2.

Inside this structure, the envelopes are stacked in an area including a vertical holder 3 and a horizontal holder 4. Envelopes 5 are piled on two extraction endless belts 6 and 6' where the top portion of the belt is slightly higher than the horizontal holder 4.

A cylindrical press 7 is applied to the top of the pile of envelopes; two cables 9, 9' pass about the return pulley 11 and are looped about shaft 10. The presence of the cylindrical press 7 on the top of the pile of envelopes 5 is detected by a contactor 12. Indeed, the cable 9 goes through a perforation in a tongue of the contactor 12. When the press is lifted and the cable is taut, the contactor is in closed position: when the press presses on the envelopes and the cable is loose, the contactor is in open position.

The means for extracting the envelopes comprises rollers 13 mounted on a shaft 14 and pairs of rollers 15 mounted on shaft 16. Each roller 13 slightly overlaps the associated pair of rollers 15 so that an envelope may pass between the rollers and undualate slightly.

The drive means comprise rollers 17 mounted on shaft 18 and rollers 19 mounted on shaft 20. Rollers 17 are in contact with rollers 19. Belts 6 and 6' and rollers 13. 15 and 19 are driven by a two-way motor 21 through the assembly of pulleys and belts 22, 23, 24, 25, 26, 27, 28, 29 and 30.

The means for opening the flap includes a wedge-shaped deflector 31 and a movable flap 32. Movable flap 32 is controlled by electromagnet 33 through the action of stub axle 34. In rest position, illustrated by arrow 35, flap 32 is biased by spring 37 and contacts stop 36. In working position, electromagnet 33 moves the flap 32 to the low position illsutrated by arrow 38. An optical barrier comprised of an emitting cell 39 and a receiving cell 40, informs the control unit of the passage of an envelope before the cells. The control unit thus takes as a reference point the passage of the edge of the envelope at the barrier and knows the position of the envelope at all times in the system since the motor 21 is a servo-control actuator (step-by-step motor, DC motor with encoding . . . )

The various steps required to complete a cycle of unstacking and opening of an envelope are illustrated in FIGS. 3 to 8.

Figure 3:
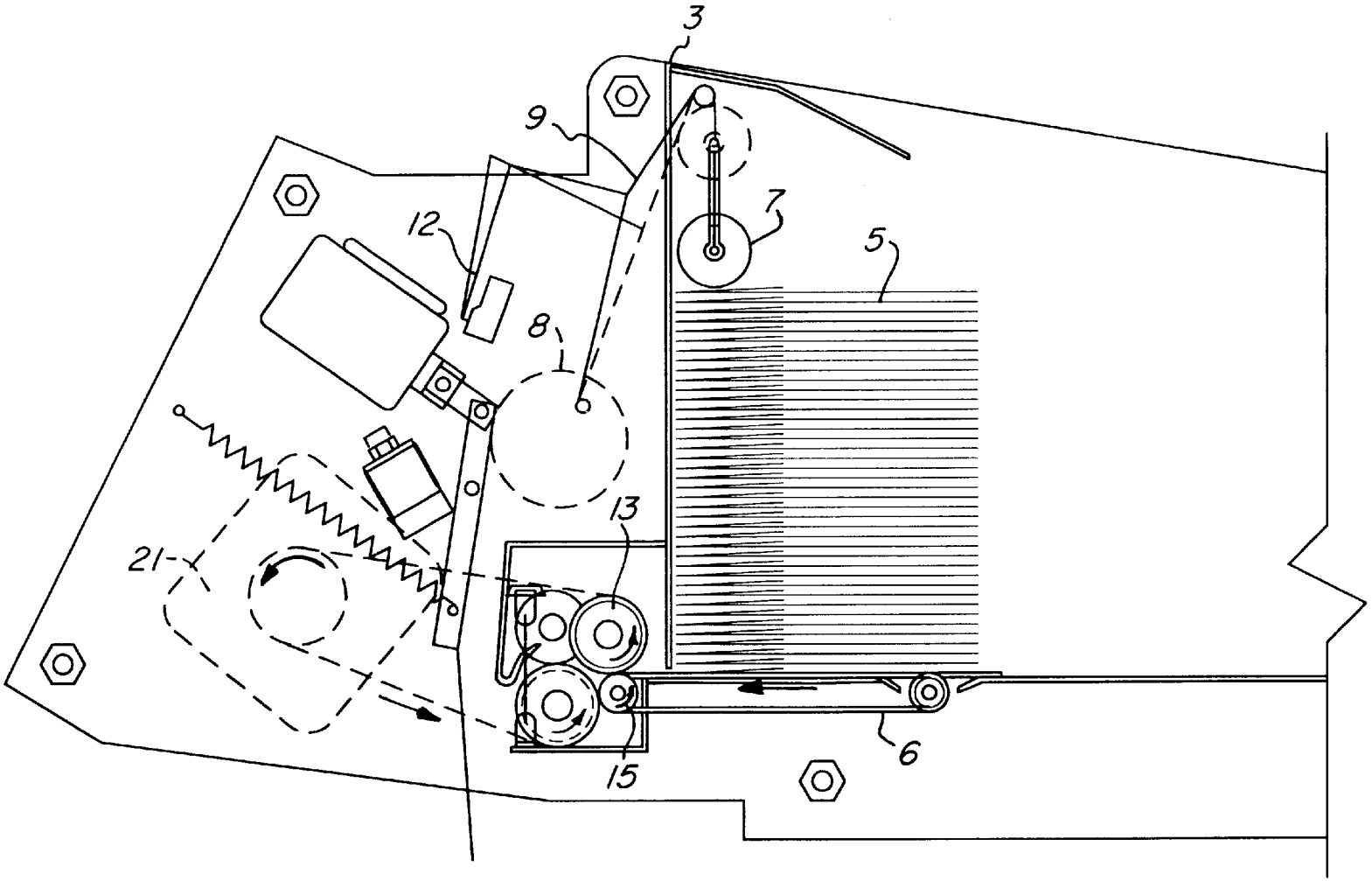
FIGS. 3, 4, 5, 6, 7 and 8 are internal cross-sectional views of the device of FIG. 1. showing each step of the device of FIG. 1.

In FIG. 3, the device is in start position. The envelope press 7 is brought to the raised position by motor 8 and by cables 9 and 9'. The cables are thus taut and contactor 12 is closed. The contactor informs the control unit that the press is in the raised position and that the system is ready to receive a pile of envelopes to be unstacked. The stack of envelopes is placed manually by an operator or automatically by a mechanical system which does not form part of the invention. The envelopes are stacked in contact with the holder 3 and are placed with the flaps forwardly and upwardly. Once the envelopes are in place, the press 7 is lowered to press against the top of the stack by the motor 8 and the cables 9 and 9'. When the cables 9 and 9' are loose, contactor 12 changes state and indicates to the control unit that the press 7 presses against the stack of envelopes. Motor 21 is then driven in rotation, which drives mechanical actuators associated with it, i.e. the extraction and transport belts 6 and 6' and the separating means 13 and 15. The envelope in contact with the belts 6 and 6' is drawn towards the separator 13, 15. Often, more than one envelope may be drawn. The envelopes drawn with the lowest envelope are blocked in the stack by the action of roller 13 which rotates in a direction opposite to the direction of travel of the lowest envelope. The lowest envelope does travel forwardly since it is in direct contact with the drive belts 6 and 6' and thus benefits from a greater driving power.

Figure 4:
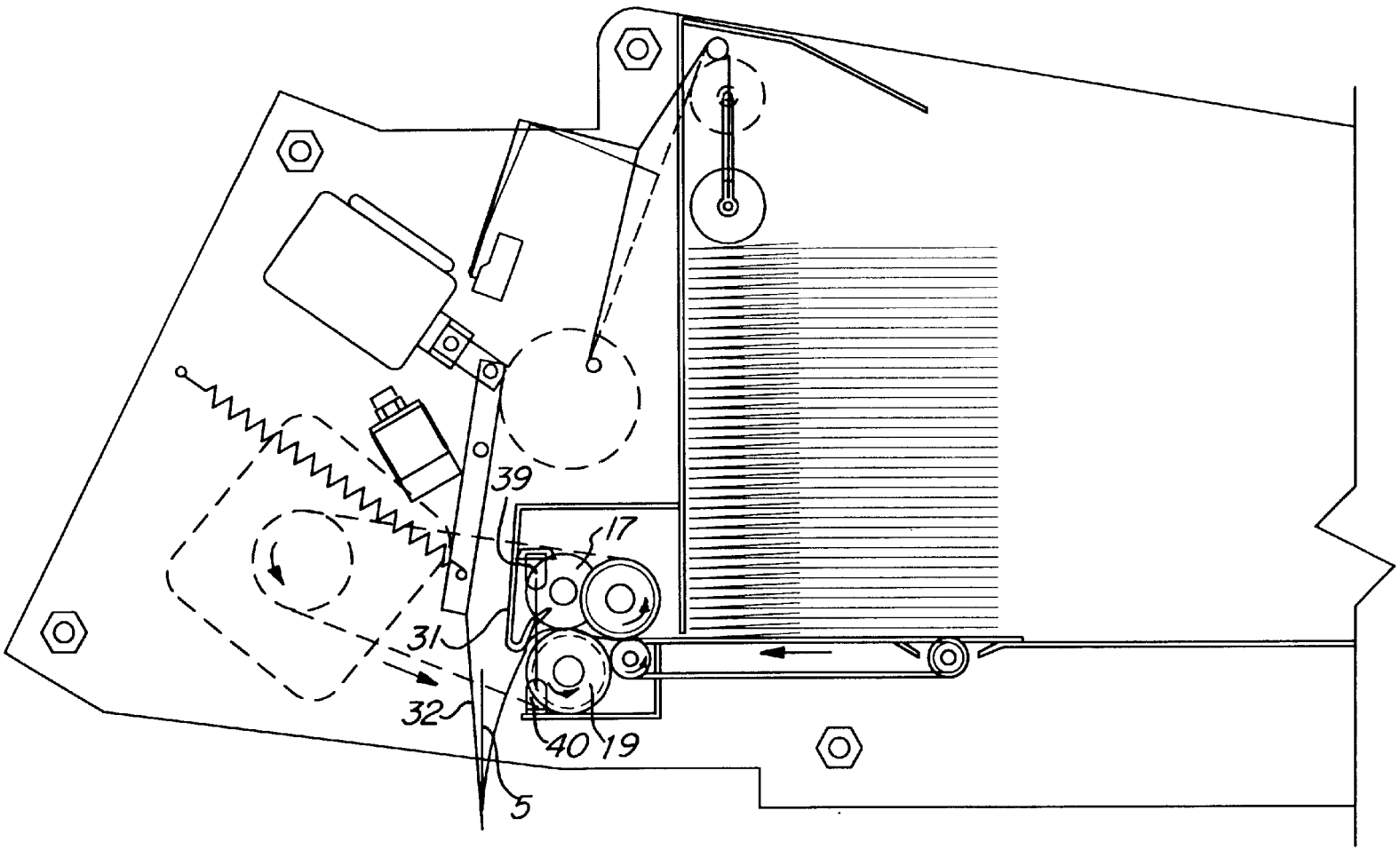

FIG. 4 shows the next step. The envelope 5 continues along its path. It is taken up by the driving rollers 17 and 19 and passes before the optical barrier formed by cells 39 and 40. The edge of the envelope slides along the fixed deflector 31 and then meets movable deflector 32. The envelope 5 thus curves considerably and the flap of the envelope opens when the envelope is no longer in contact with the fixed deflector 31. Since the length of the flap is known, the control unit knows the distance along which the envelope must travel between the crossing of the optical barrier 39, 40 and the complete opening of the flap from the envelope.

Figure 5:
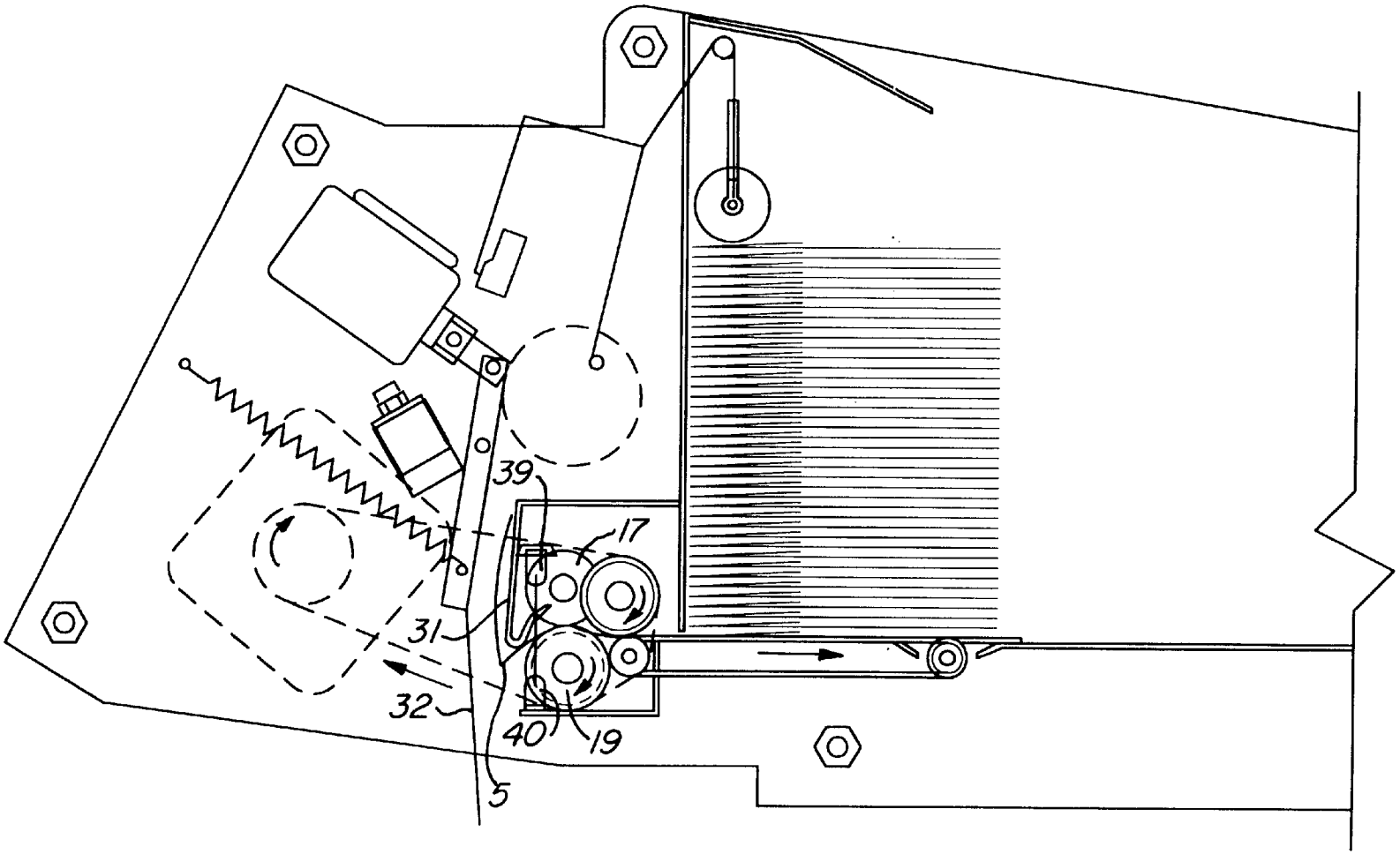

FIG. 5 shows the next step. The rotation of the motor 21 is reversed. The body of the envelope thus slides partially back into the stack of envelopes. The opened flap slides along the vertical portion of deflector 31.

Figure 6:
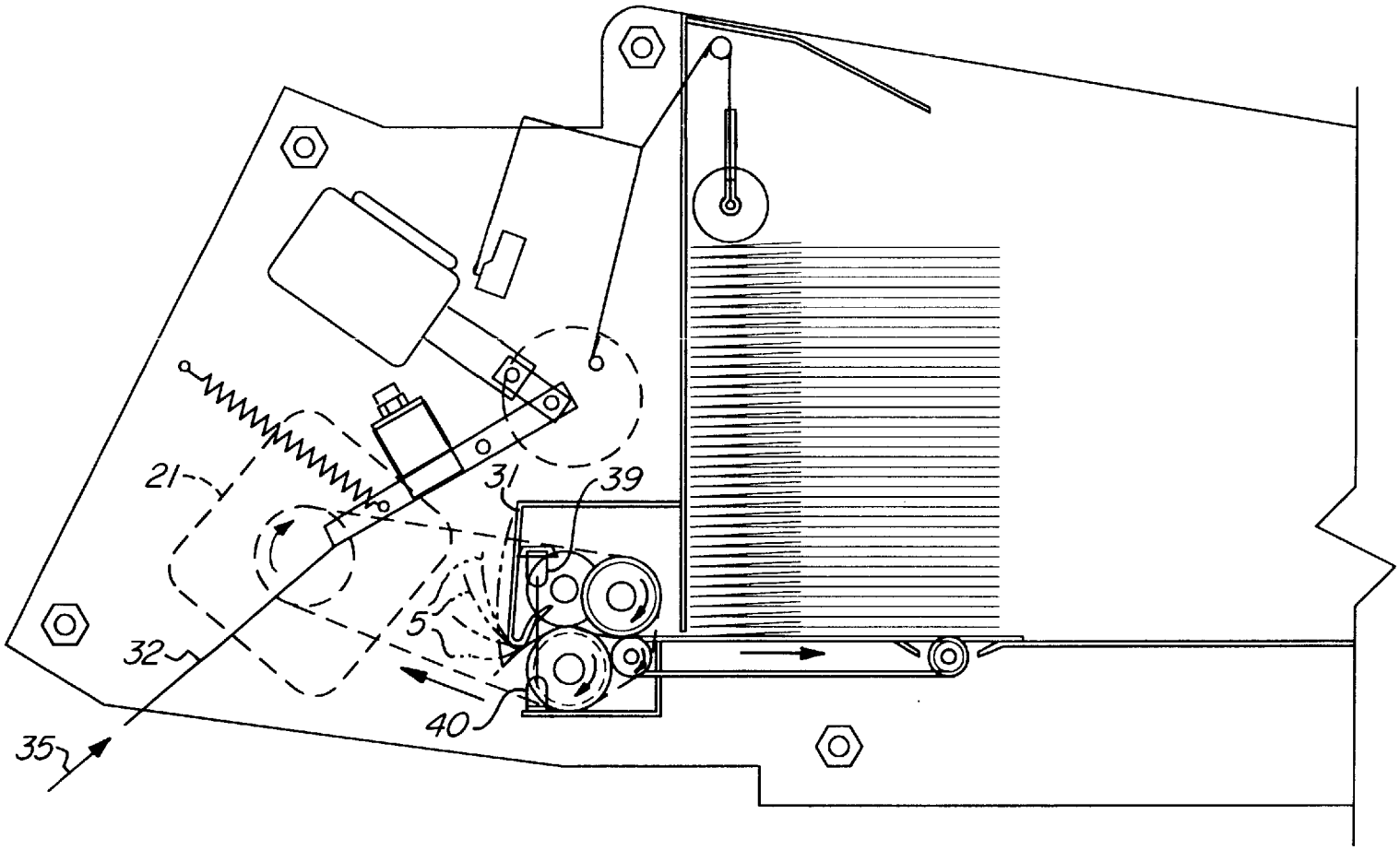

FIG. 6 shows the next step. The movable flap 32 is then brought to the raised position shown by arrow 35 when the control of the electromagnet 33 is stopped. The envelope 5 continuing its backward travel, the flap further opens under the action of the wedge-shaped deflector 31. When the flap travels backwardly beyond the optical barrier 39 and 40, the control unit stops the reverse rotation of the motor 21.

Figure 7:
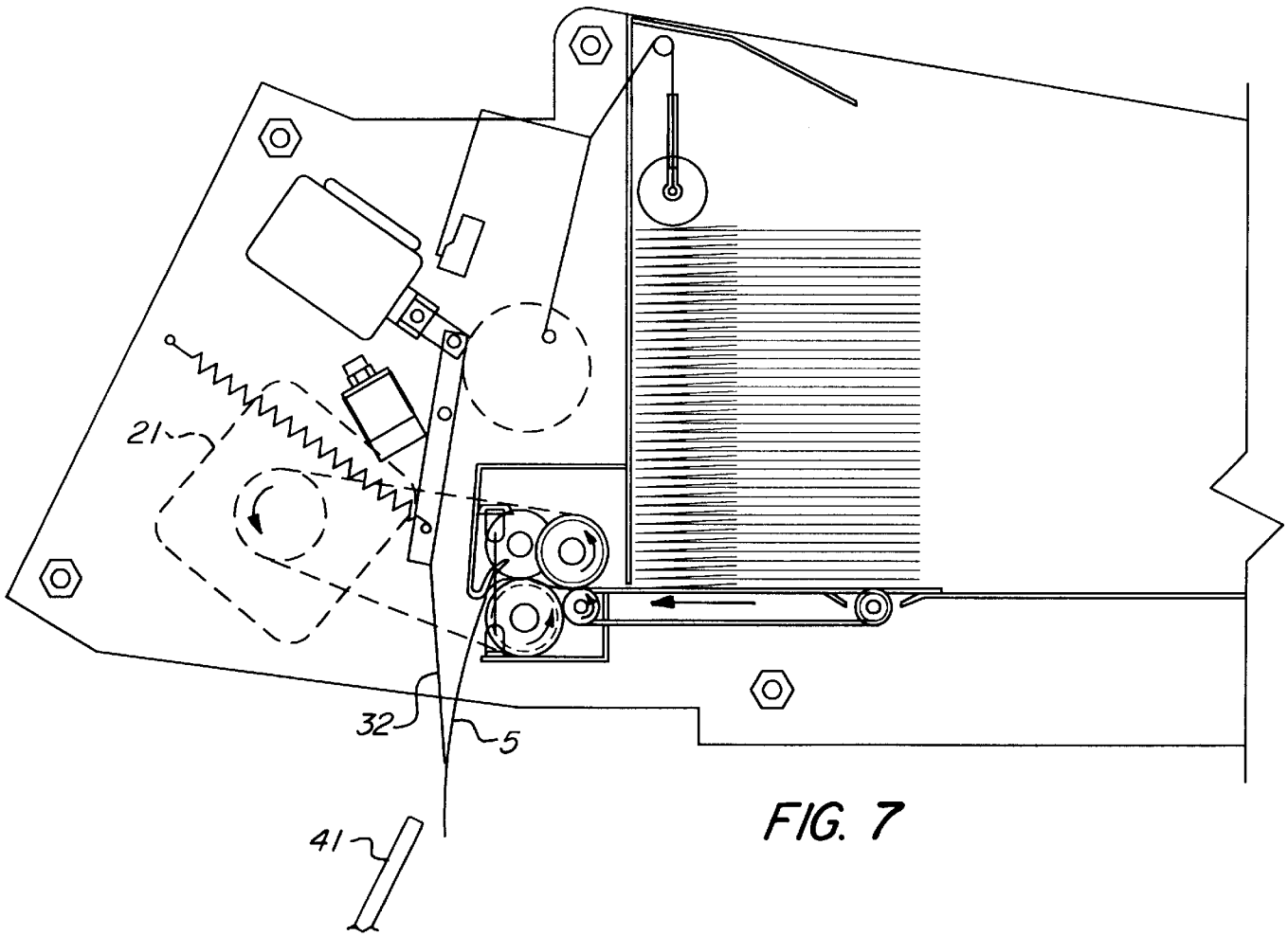

FIG. 7 shows the next step. The movable flap 32 is lowered. The motor 21 is then driven in forward rotation: the envelope then moves towards the left. The flap, which is now in front of the envelope, is deviated downwardly by movable flap 32 and passes under fingers 41 of reception of the dynamic insertion system, which is not a part of the present invention. This system may be the one described in U.S. Pat. No. 5,410,860 where fingers 1–1' correspond to fingers 41 of FIG. 7 of the present invention. Reference may also be made to application no. WO-A-95/16578.

Figure 8:
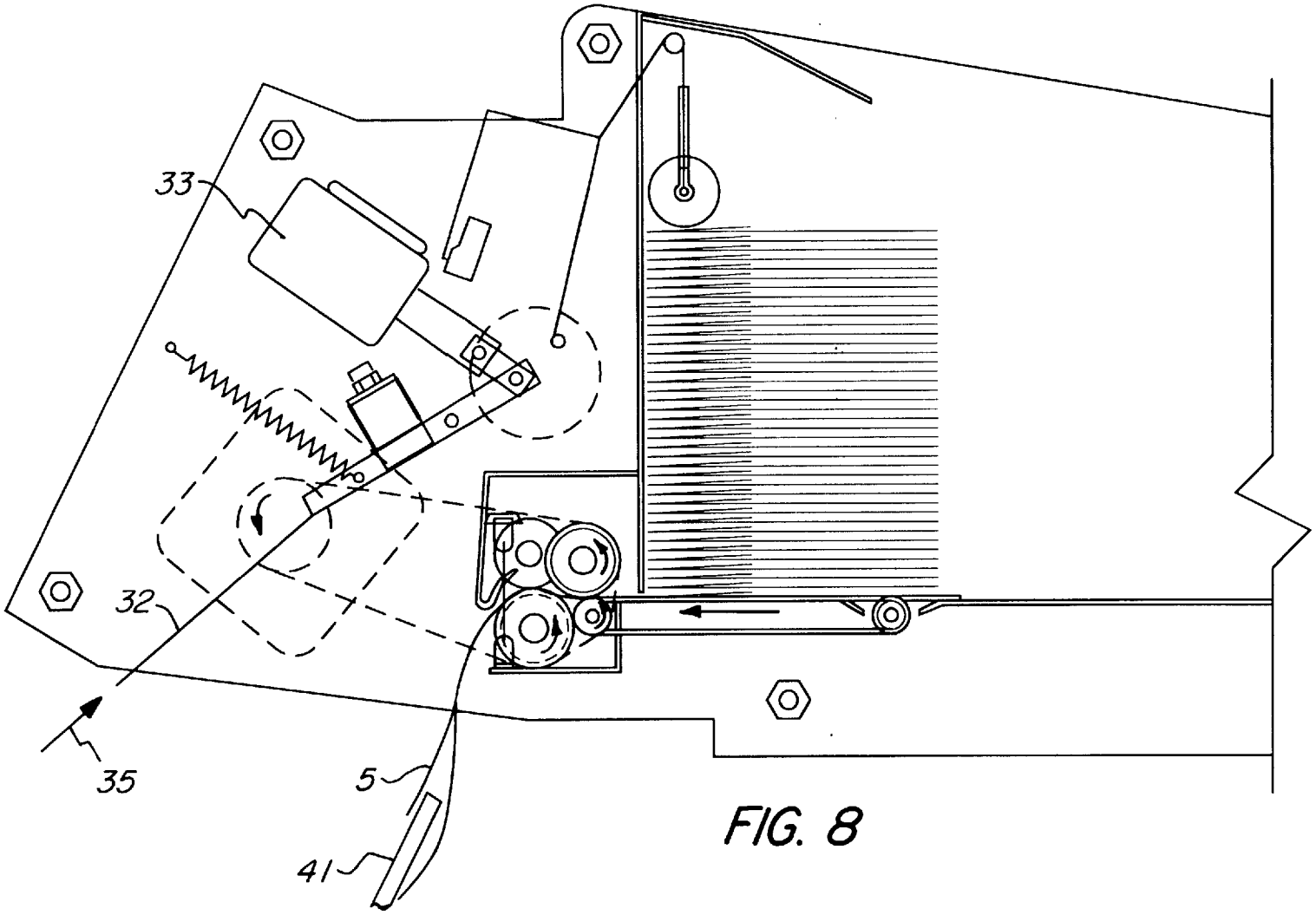

FIG. 8 presents the final step. The movable flap 32 is brought back to the raised position shown by arrow 35 through the action of the electromagnet 33. The deviation of the envelope stops, which permits it to open slightly and to engage fingers 41 of reception of the dynamic insertion system. The cycle is then complete.

Although the present invention has been explained hereinabove by way of a preferred embodiment thereof it should be pointed out that any modifications to this preferred embodiment within the scope of the appended claims is not deemed to alter or change the nature and scope of the present invention.

What is claimed is:

1. A device for unstacking and opening envelopes from a pile of envelopes with the flap down, comprising:

a frame (1, 1', 2), means (3, 4) for stacking a pile of envelopes (5) with folded-down flaps;

means (6, 6') for extracting an envelope from the bottom of said pile;

first drive means (17, 19) for moving said extracted envelope downstream from said first drive means;

characterized in that said system further includes:

a fixed wedge-shaped deflector (31) arranged at an angle to the feed direction downstream from said first drive means (17, 19);

second drive means (17, 19) for moving the extracted envelope downstream, located upstream from said fixed wedge-shaped deflector (31);

detection means (39, 40) for detecting the position of the extracted envelope (5) with respect to said deflector;

control means for controlling the extraction means (6, 6') and the first and second drive means (17, 19) responsive to a signal from said detection means in order to control:

firstly, the extraction of said envelope and its forward feeding, flap folded and oriented upwardly and forwardly, at the front and on the side of said deflector relative to the path until said flap has been deflected and travelled beyond said deflector;

secondly, the feeding of said envelope backwards so that said flap and said envelope position themselves over said deflector as they move backwards, whereby the flap is folded out during backward movement until it is coplanar with the body of the envelope; and thirdly, the final feeding of the envelope forwardly in the downstream direction of the device.

2. A device according to claim 1, characterized in that said extraction means comprise an endless belt (6, 6') placed at the bottom (4) of the stacking means and cooperating with an extraction space at the bottom of a wall (3) of the stacking means.

3. A device according to claim 1, characterized in that said device further comprises envelope separating means (13, 15), located downstream from said extraction means.

4. A device according to claim 3, characterized in that said separating means comprise a pair of overlapping rollers (13, 15) placed on either side of the path of the envelope and rotating in the same direction.

5. A device according to claim 1, characterized in that said first and second drive means are integrated and comprise opposite rollers (17, 19) in mutual support.

6. A device according to claim 5, characterized in that said rollers (17, 19) are driven by a two-way motor (21).

7. A device according to claim 1, characterized in that said device further includes a movable flap (32) located downstream from said deflector (31).

8. A device according to claim 1, charaterized in that said device further includes insertion fingers (41) located downstream from the path of the envelope.

9. A device according to claim 1, characterized in that said device further includes press means (7) for pressing on said stack of envelopes.

10. A device according to claim 9, characterized in that said device further includes detection means (12) for actuating said press means (7) and actuating said unstacking device.

11. A device for unstacking and opening envelopes from a stack of envelopes comprising:

a frame having a receptacle area for receiving a stack of envelopes;

an extractor for extracting an envelope from the bottom of the stack of envelopes;

a feeder for moving the extracted envelope along a feed path, said feeder capable of moving the extracted envelope along the feed path in a forward feed direction and a backward feed direction;

a fixed deflector downstream from said feeder, arranged at an angle relative to the forward feed direction; and, a controller for controlling said extractor and the feed direction of said feeder.

12. The device for unstacking and opening envelopes of claim 11 further comprising a detector for detecting the presence of the extracted envelope along the feed path and wherein said controller is responsive to a signal from said detector in order to control said extractor and the feed direction of said feeder.

13. A device for unstacking and opening envelopes from a stack of envelopes comprising:

a frame having a receptacle area for receiving a stack of envelopes;

at least one endless belt at the bottom of the receptacle area for extracting an envelope from the bottom of the stack of envelopes, the flap of the envelope folded and oriented upwardly and in a forward direction;

at least one set of cooperating drive rollers rotating in opposite directions, and arranged such that the extracted envelope can pass therebetween, for moving the extracted envelope in a feed direction dependent on the direction of rotation of said drive rollers;

a fixed wedge-shaped deflector downstream from said drive rollers, arranged at an angle relative to the forward feed direction;

a position detector for detecting the position of the extracted envelope with respect to said fixed deflector;

a controller for controlling said endless belt and said drive rollers, said controller being responsive to a signal from said position detector in order to control: (i) the extraction of the envelope and its forward feeding until the flap of the envelope has been deflected and traveled beyond said fixed deflector, (ii) the feeding of the envelope backwards so that the flap of the envelope and the body of the envelope position themselves over said fixed deflector as they move backwards, whereby the flap of the envelope is folded out during backward movement until it is coplanar with the body of the envelope, and (iii) the final feeding of the envelope in the downstream direction.

14. The device for unstacking and opening envelopes of claim 13 further comprising at least one set of separator rollers located downstream from said endless belt and rotating in the same direction for allowing only a single extracted envelope to pass therebetween at one time.

15. The device for unstacking and opening envelopes of claim 14 wherein said separator rollers are driven by a two-way motor.

16. The device for unstacking and opening envelopes of claim 13 further comprising a movable deflector located downstream from said fixed deflector to aid in deflecting the flap of the envelope.

17. The device for unstacking and opening envelopes of claim 13 further comprising a press for pressing on the stack of envelopes.

18. The device for unstacking and opening envelopes of claim 17 further comprising a press detector for actuating said press and actuating said endless belt, said drive rollers, said detector and said controller when said press is lowered onto the stack of envelopes.

19. The device for unstacking and opening envelopes of claim 18 wherein said press detector comprises a contactor.

20. The device for unstacking and opening envelopes of claim 13 wherein said position detector comprises an optical barrier having an emitting cell and a receiving cell.

21. A method for unstacking and opening envelopes from a stack of envelopes comprising the steps of:

providing a stack of envelopes;

extracting an envelope from the bottom of the stack of envelopes, the flap of the envelope folded and oriented upwardly and in a forward direction;

feeding the extracted envelope in a forward direction until the flap of the envelope has been deflected and traveled beyond a fixed deflector;

feeding the extracted envelope in a backward direction so that the flap of the envelope and the body of the envelope position themselves over said fixed deflector as they move backwards, whereby the flap of the envelope is folded out during backward movement until it is coplanar with the body of the envelope.

22. The method for unstacking and opening envelopes of claim 21 further comprising the steps of detecting the presence of an envelope, generating a signal indicative of the presence of an envelope, and using the generated signal to control said forward feeding and said backward feeding steps.

* * * * *